US006802459B2

(12) United States Patent
Renkl et al.

(10) Patent No.: US 6,802,459 B2
(45) Date of Patent: Oct. 12, 2004

(54) DEVICE FOR PREPARING THE WALLS OF A MOLD FOR MOLDING OR SHAPING TO MAKE THEM READY FOR THE NEXT MOLDING CYCLE

(75) Inventors: Hans-Dieter Renkl, Berghülen (DE); Douwe Marten Kok, Scheemda (NL); Thomas Junker, Göggingen (DE); Karl-Heinz Keim, Neu-Ulm (DE)

(73) Assignee: Acheson Industries, Inc., Port Huron, MI (US)

( * ) Notice: Subject to any disclaimer, the term of this patent is extended or adjusted under 35 U.S.C. 154(b) by 0 days.

(21) Appl. No.: 10/373,245

(22) Filed: Feb. 24, 2003

(65) Prior Publication Data

US 2003/0155450 A1 Aug. 21, 2003

Related U.S. Application Data

(62) Division of application No. 09/707,173, filed on Nov. 6, 2000, now Pat. No. 6,546,994.

(51) Int. Cl.[7] ..... B05B 1/28

(52) U.S. Cl. ..... 239/290; 239/223; 239/224; 239/690; 239/708

(58) Field of Search ..... 239/223, 224, 239/690, 700, 708, 290

(56) References Cited

U.S. PATENT DOCUMENTS 4,601,921 A * 7/1986 Lee ..... 239/224
4,792,094 A * 12/1988 Tachi et al. ..... 239/224

* cited by examiner

*Primary Examiner*—Robin O. Evans
(74) *Attorney, Agent, or Firm*—Dinnin & Dunn, P.C.

(57) ABSTRACT

The invention provides a sprayer for spraying mold wall treatment agent or another liquid. The liquid is sprayed onto, for example, the walls of a mold or some other article. The sprayer includes a spray element body and a rotor mounted with freedom to rotate around an axis of rotation in the spray element body. An atomizing element is attached to one end of the rotor. A first feed line for mold wall treatment agent or another liquid to be sprayed is provided, as well as a second feed line for control air which directs mold wall treatment agent atomized by the atomizing element in the desired spray direction.

19 Claims, 6 Drawing Sheets

10
12
12a
12b
12c
12d
12e
12f
14a
14b
16
18
22
24
26
28
30
32
32a
34
36
36a
38
38a
40
40a
40b
42
44
44a
44b
44c
44d
44e
46
48
50
52
56
58
60
64
F
B 116e
120
122
120a
112
116
R
118
116a
110
26
117
124
128
116d
116c
130
124a
136
130a
126
132'
132
116b
130b
H'
H
S
114
120b

DEVICE FOR PREPARING THE WALLS OF A MOLD FOR MOLDING OR SHAPING TO MAKE THEM READY FOR THE NEXT MOLDING CYCLE

This application is a divisional of Ser. No. 09/707,173 filed Nov. 6, 2000, now U.S. Pat. No. 6,546,994.

TECHNICAL FIELD

The invention pertains to a process for preparing the walls of a mold for the molding or shaping of a molded part after completion of a molding cycle and removal of the molded part from the mold to make the mold ready for the next molding cycle, comprising the following steps:

(a) the mold walls are brought to the desired temperature; and (b) a mold wall treatment agent is applied to the walls of the mold.

The invention pertains in particular to a spraying device used in carrying out the above process.

BACKGROUND OF THE INVENTION

Processes of this type are known according to the state of the art and are used, for example, in the production of molded parts by molding processes such as those known in professional circles under names such as mold-casting, thixo-casting, thixo-forming, Vacural mold-casting, squeeze casting, etc. The state of the art will be explained below by way of example on the basis of the preparation of the mold walls of a mold for the die-casting of metal, but it is to be emphasized that analogous problems also occur in other shaping processes such as forging.

To produce a molded part, liquid or semi-liquid metal consisting of a light metal or heavy metal alloy is usually introduced under pressure into a divided, closed mold of steel and allowed to solidify. At the same time, the mold heats up as a result of the heat transferred to it from the solidifying material. Under production conditions, that is, during the production of as many castings as possible in the shortest possible time, the temperature of the mold would continue to increase. To achieve good-quality castings, how ever, the mold should have the same initial temperature at the start of each production cycle. Under production conditions, therefore, the mold must usually have heat removed from it continuously, so that thermal equilibrium is reached between the quantity of heat which the metal transfers to the mold and the quantity of heat which the mold releases as radiation to the surroundings or which is removed from it by supplemental cooling, with the result that an approximately uniform mold temperature is maintained.

Of course, instead of supplemental cooling, it may also be necessary to provide supplemental heating to the mold. This will be the case, for example, when only a small amount of metal is poured into a very heavy mold, that is, when molded parts with very thin members are produced. In this case, therefore, it can happen that the mold radiates off more heat to the surroundings that is desirable for the maintenance of a mold temperature favorable to the casting process. Therefore, with reference to the present invention, it is said in very general terms that the mold is "tempered", to cover both the possibility that the mold must be cooled as well as the possibility that it must be heated.

In addition to the need to temper the mold, it is also necessary to treat the surface of the mold walls with a lubricating and mold-release agent after removal of the last molded part and before the introduction of fresh liquid metal into the mold. This mold wall treatment agent has the primary job of preventing the introduced metal from welding or sticking to the material of the mold, of guaranteeing that the finished part can be removed from the mold, and of lubricating the moving parts of the mold such as the ejectors or pushers. In certain processes, the mold wall treatment agent has the additional task of reducing the heat transfer between the introduced metal and the mold during the filling process. The layer of mold wall treatment agent applied to the mold wall should have the most uniform possible thickness, because the layer can rupture at points where it is too thin, and this will result in turn in the welding of the introduced metal to the mold material. If the layers are too thin, furthermore, too much heat can be transferred from the introduced metal to the mold, with the result that the introduced metal cools down too quickly just after it has been introduced and thus prevents the mold from being filled sufficiently. But layers which are too thick can also impair the quality of the castings by occupying too much of the volume of the mold. According to the conventional method, the mold walls are sprayed with a mixture of mold wall treatment agent and water each time a molded part is removed from the mold, as described in, for example, DE 4,420,679 A1 and DE 195-11,272 A1. The advantage of the use of these mixtures of treatment agent and water is the savings in time, which results from the fact that the surface of the mold wall is cooled by the sprayed-on water at the same time that the mold wall treatment agent is applied to the walls. One of the problems which has had to be dealt with in this method, however, is the Leidenfrost effect. That is, when the droplets of spray land on the hot surface of the mold wall, a vapor barrier forms between the droplets and the surface. This barrier pre vents the droplets from completely wetting the surface. Some of the sprayed-on mixture of treatment agent and water therefore runs off the surface of the mold wall without cooling it, lubricating, it, or wetting it, and giving it the required release properties.

To cool and the mold wall surface and to be able to coat it with mold wall treatment agent sufficiently in spite of this problem, it is necessary to apply an excess of the treatment agent-water mixture. But then the trade-off must be accepted that a considerable amount of the treatment agent-water mixture will run off the surface of the mold walls unused and then must be collected and disposed of. This raises significant problems in terms of environ mental compatibility, which will be explained in greater detail below on the basis of an example.

If we assume that a foundry uses approximately 5 kg of mold wall treatment agent concentrate per 1,000 kg of cast aluminum and that this concentrate is diluted with water in a ratio of 1:100 before spraying, i.e., a total of about 500 liters of treatment agent-water mixture is sprayed, and if we also assume that about 80% of this amount runs off unused from the mold walls as excess, this means that approximately 400 liters of waste liquid must be disposed of per ton of cast aluminum. This is a conservative estimate. A less favorable but equally realistic estimate results in a volume of approximately 900 liters for disposal per ton of aluminum. In a medium-sized casting shop with a capacity of about 5,000 tons of aluminum per year, it is therefore necessary to dispose of 2,000–4,500 m of waste liquid.

SUMMARY OF THE INVENTION

Against this background it is a task of the present invention to improve the environmental compatibility of the process of the general type described above. It is a further task to provide a sprayer device useful in carrying out the process.

This task is accomplished in accordance with the invention in that, in the process of the general type in question, steps (a) and (b) are conducted in the sequence indicated, independently of each other. Thus, in step (a), the supply of heat to or the removal of heat from the mold walls is controlled as a function of the process conditions and/or the environmental conditions, preferably under the control of a program; whereas, in step (b), the mold wall treatment agent is applied in a controlled manner, preferably in a program-controlled manner. According to the invention, therefore, the mold walls, especially their surfaces, are first brought to the desired temperature before they are coated in a process independent of this tempering. Specifically, that is, there is no overlap in time between the tempering of the mold and the application of the mold wall treatment agent. The advantages of the process according to the invention will be explained in the following, again merely by way of example, on the basis of the use of the previously discussed casting process, in which the tempering of the mold walls usually takes the form of cooling.

From another viewpoint, the invention pertains to a device for preparing the walls of a mold for the molding or shaping of a molded part after completion of the molding cycle and removal of the molded part from the mold to pre pare the walls of the mold for the next molding cycle. With respect to the design and function of this mold wall treatment device and the advantages which can be achieved by its use, reference is made to the discussion of the process according to the invention discussed above.

According to yet another viewpoint, the invention pertains to a spray element for spraying the walls of a mold for the molding or shaping of a molded part with a mold wall treatment agent, the spray element comprising a rotor, which is mounted in a spray element body so that it can rotate around an axis, to one longitudinal end of which rotor an atomizing element is attached, the spray element also comprising a feed line for mold wall treatment agent, from which the mold wall treatment agent is able to pass to the atomizing element, and a feed line for control air, which serves to direct the mold wall treatment agent atomized by the atomizing element to the mold wall to be sprayed, and where an outlet of the control air feed line is provided near the outside periphery of the atomizing element. That is, the invention also pertains to a spray element with centrifugal atomization and air control as has already been mentioned several times above.

BRIEF DESCRIPTION OF THE DRAWINGS

FIG. 1 shows a schematic diagram of a mold spray device designated 10 in the following, in which the process according to the invention can be used. Mold spray device 10 is used in the exemplary embodiment illustrated here to prepare mold walls 12*a*, 12*b* of a mold 12 for the next work procedure as part of the production of molded parts by means of, for example, the aluminum die-casting process.

DETAILED DESCRIPTION OF PREFERRED EMBODIMENTS

Figure 1:
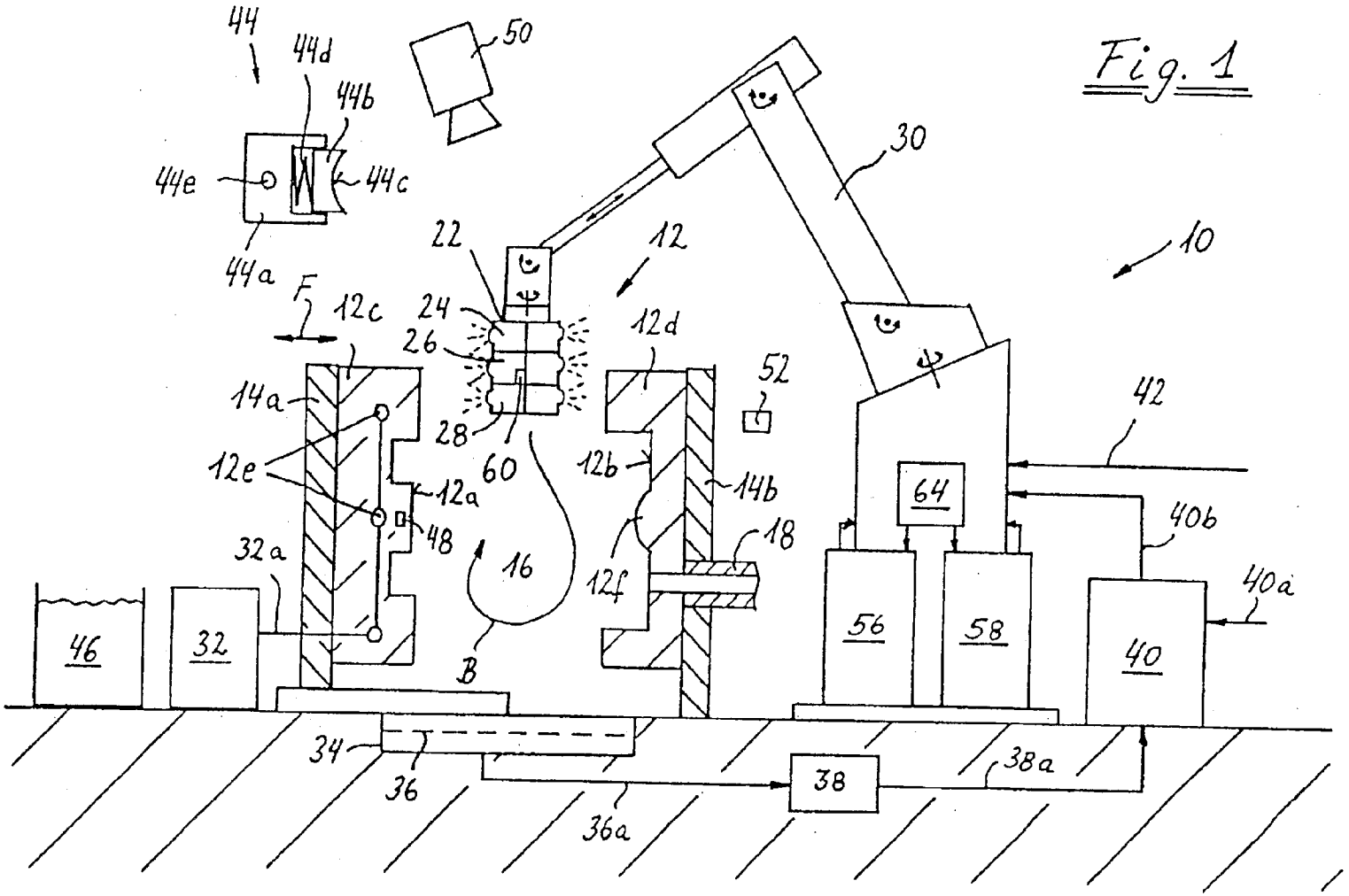
FIG. 1 shows a schematic diagram of a mold spray device according to the invention, which can be operated according to the invention with the use of the spray element according to the invention.

As a result of the separation in time between tempering and coating, it is possible to allow each of the two component processes to proceed under the most favorable possible conditions for it alone, which has a favorable effect on the environmental compatibility of the process according to the invention.

First, the mold wall surface is cooled in a controlled manner under consideration of the process conditions and/or environmental conditions. This controlled cooling does not exclude the possibility that the coolant, prefer ably pure water, is applied in excess, at least in certain time intervals, to the mold walls to counter the Leidenfrost effect. As a result of cooling with an excess of water, a great deal of heat can be removed from the mold in a relatively short time, which makes it possible for the mold temperature desired for the next filling process to be approached quickly. During the final phase of the tempering process, however, the control of the cooling process makes it possible to adjust the temperature precisely to the desired value. Cooling with an excess is perfectly safe in terms of the environment, however, because water can be used as a coolant according to the invention, and the excess water running off the mold can be purified of metal and treatment agent residues by filtration, centrifuging, settling, sedimentation, etc., and then either reused or, under observance of the local regulations, easily discharged into the municipal sewer system.

Then the mold wall treatment agent is applied in a controlled manner. Because the mold walls have been cooled first, the degree to which the Leidenfrost effect interferes with the wetting of the mold wall surface is at least considerably less than it would have been according to the state of the art, if it occurs at all. To achieve a sufficient coating, therefore, the mold wall treatment agent does not need to be applied in an excessive quantity. At most, possibly only a very small excess will have to be applied to the mold wall surface, which means that either no disposal problems at all or correspondingly reduced disposal problems remain to be dealt with. The controlled application of the mold wall treatment agent makes it possible not only to minimize or to eliminate the excess but also to apply a uniformly thick layer of mold wall treatment agent to the mold wall surface regardless of the topography of the mold wall.

Because of the better environmental compatibility of the process according to the invention, the disposal costs associated with every molding process are correspondingly lower when the process is used, so that, in spite of the separation in time between the tempering and the coating of the mold wall, the economy of the process according to the invention is certainly no worse than that of the process according to the state of the art and possibly better overall. In addition, it should be noted that, through the controlled tempering and the controlled application of the mold wall treatment agent, it is possible to minimize the time required for a preparation cycle.

Another improvement in the environmental compatibility of the process according to the invention can be achieved by using ready-to-use mold wall treatment agent, for example, which is taken without dilution from a transport container and applied to the mold walls. By eliminating the step of diluting the mold wall treatment agent supplied by the manufacturer of the agent, various problems can be bypassed which until now have plagued the state of the art as a result of the need to dilute a mold wall treatment agent concentrate to a ready-to-use consistency. That is, water-diluted mixtures are susceptible to attack by bacteria or fungi, which can destroy the lubricating and mold-release properties of the mold wall treatment agent. Therefore, bactericides and the like must be added to the supplied mold wall treatment agent concentrate, and these agents for their part have a disadvantageous effect on the lubricating and mold-release properties of the mold wall treatment agent. In addition, the bactericides make it more difficult to dispose of the run-off excess in an environmentally safe manner.

Because, as proposed, the mold wall treatment agent is taken directly from the transport container and applied to the mold walls, i.e., is managed in a closed system, and also because the mold wall treatment agent is ready to use, the above-discussed dilution step is eliminated according to the invention, and the risk of attack by bacteria or fungi in the process according to the invention is minimized. This risk can be further reduced by keeping the transport containers carefully sealed, by using a removal device of appropriate design, and by similar measures. Thus it is possible to eliminate completely the use of bactericides. In addition, the personnel costs for the operation, maintenance, and monitoring of the mold wall treatment agent preparation and dilution system are also eliminated.

Corresponding logic applies to the use of the corrosion-proofing agents, which are added to water-diluted mixtures to protect the mold but which hinder the formation of a film of mold wall treatment agent on the mold wall surface. Because the agent according to the invention is not diluted with water, how ever, the addition of such corrosion-proofing agents can be reduced or even completely eliminated.

If an arrangement is used in which the mold spray system includes at least two transport containers, at least one of which is connected to a spray element to supply it with agent, whereas at least one other container is held in readiness for the same purpose, the advantage is obtained that, after the one transport container has become completely empty, it is possible to switch over either automatically or manually to the other transport container and to continue removing the agent from it. The production operation thus does not need to be interrupted; on the contrary, the empty container can be replaced with a new transport container filled with mold wall treatment agent as operations continue without a break.

If the mold wall treatment agent contains at least 98 wt. % of lubricating and mold-release substances (e.g., the mold wall treatment agent can contain at least one silicone oil or similar synthetic oil and/or at least one poly olefin wax such as a polyethylene wax or polypropylene wax as lubricating and mold-release substances) and no more than 2 wt. % of auxiliary materials such as corrosion-proofing agents, bactericides, emulsifiers, solvents such as water, etc., then it is possible to bypass another problem. Unless they are used immediately, water-diluted mold wall treatment agents tend to separate in spite of the addition of emulsifiers. This separation can be prevented by agitating the mixture, for example. Agitation, however, such as by means of mixing machines or centrifugal pumps, subjects the lubricating and mold-release substances of the mold wall treatment agent to repeated shear stress and impairs their lubricating and mold-release properties. Because of the absence of solvent, however, there is no need to fear separation, and it is therefore possible to eliminate the agitation of the mold wall treatment agent. This has a favorable effect on the lubricating and mold-release properties of the mold wall treatment agent, and at the same time it lowers the acquisition and maintenance costs of the system by eliminating the need for a mixing machine. Finally, it allows the effective utilization of the lubricating and mold-release substances.

Because of the small water content, furthermore, the application of the mold wall treatment agent to the hot mold wall surface is subject to little or no interference from the Leidenfrost effect. Therefore, the mold wall treatment agent, which can have a viscosity in the range of about 50–2,500 milliPascal seconds at a temperature of 20° C., for example (measured with a Brookfield viscometer at 20 rpm), can be brought into contact with a much hotter mold wall surface than was possible in the mold wall treatment systems explained above according to the state of the art. Thus, the mold wall surface does not need to be cooled down as much; this offers, first, the advantage of time savings and, second, the advantage of reduced thermal stress on the mold. Because the ready-to-use mold wall treatment agent is able to wet the mold walls and to form a lubricating and effective release layer on it even at a mold wall temperature of about 350–400° C., the mold wall can be treated at a temperature favor able for the next molding cycle. These favorable temperatures are usually in the range of 150–350° C., but they can also be even higher. Mold wall treatment agents with high-temperature wetting properties are described in, for example, The small water content of the mold wall treatment agent also offers the advantage that the layer applied to the mold wall surface also contains few if any water inclusions. In the presence of such water inclusions, there is the danger that the water vapor which forms from these water inclusions as the liquid metal is being poured into the mold cannot escape from the mold and leads to the formation of pores in the casting, which significantly impair its quality. This danger is significantly reduced if not completely eliminated when the water-free mold wall treatment agent according to the invention is used, with the result that castings with very few if any pores can be obtained.

With respect to the above-cited temperature range prevailing at the surface of the mold wall during the application of the mold wall treatment agent, it is proposed that the flash point of the mold wall treatment agent be at least 280° C.

To ensure that the mold wall treatment agent is finely atomized, it is proposed that, for example, the mold wall treatment agent, in view of its corn position and high viscosity as indicated above, be applied to the mold walls by means of at least one spray element with centrifugal atomization and air control. The design and function of spray elements such as this will be discussed in greater detail further below.

It should be emphasized, however, that the process according to the invention can also be implemented with conventional spray elements, especially when water-diluted mold wall treatment agents are used. For example, the spray elements known from DE 4,420,679 A1 and DE 195-11,272 A1 can be used.

As part of the controlled application of the mold wall treatment agent, the quantity of mold wall treatment agent discharged per unit time onto the mold walls can, for example, be detected by sensors, which measure the volume-flow rate and/or the mass flow rate. The thickness of the layer of mold wall treatment agent applied to the mold walls can be controlled by variation of the trajectory of the spray element, of which there is at least one, and/or by variation of the speed of spray element or elements and/or by variation of the quantity of mold wall treatment agent discharged per unit time by the spray element or elements.

As already mentioned above, when mold wall treatment agents without significant amounts of substances lacking lubricating or mold-release properties are used, and when the mold wall treatment agent is atomized finely in con junction with program-controlled application which releases only very small amounts of gaseous components, thin, uniform layers of the mold wall treatment agent can be formed on the hot surface of the mold walls. This is especially important when the goal is to produce low-porosity or weldable castings.

Heat can be supplied to and removed from the mold walls in various ways. According to a first design variant, it is possible, for example, to apply an appropriately tempered fluid to the mold walls. In principle, the tempered fluid can be an appropriately tempered gas. Because of the better heat-transfer properties of liquids, however, the use of a tempered liquid such as water is preferred.

For example, the mold walls can be cooled by applying a liquid to, preferably by spraying a liquid onto, them and by allowing it to evaporate. According to an advantageous elaboration, demineralized water is used for this purpose, as a result of which a mold wall treatment agent layer highly effective in terms of its lubricating and release properties will be obtained. If, namely, as is conventional in the processes according to the state of the art, tap water is used, the CaO and MgO present in this tap water can, upon evaporation from the surface of mold wall, form a coating such as a lime deposit, which impairs the lubricating and release action of the mold wall treatment agent applied thereafter. In the worst case, this impairment can lead to the rupture of the mold wall treatment agent film as the metal is being poured in and thus to the welding of this metal to the mold. This can be prevented by the use of demineralized water. Although, in principle, it is possible to use additives which increase the tempering effect, according to what has been said above care should be taken to ensure that these additives do not interfere with the lubricating and release properties of the mold wall treatment agent. The corrosive effect of water, especially demineralized water, can be remedied by the addition of corrosion-proofing agents. The degree of demineralization and the amount of corrosion-proofing agent added can be selected under consideration of all the economic aspects.

As in the state of the art, the cooling liquid can be applied in excess to the mold walls, because, in the process according to the invention, the excess cooling liquid running down from the mold does not give rise to any environmental concerns. In addition, the cooling liquid running down from the mold walls can be collected and reused, possibly after a purification treatment such as filtration, centrifuging, settling, sedimentation, etc.

If necessary, the mold wall can be dried after it has been cooled with the liquid; it is preferably blown dry.

According to a second variant of the invention for arriving at the desired temperature at the surface of the mold walls, at least a certain area of the surface of the mold walls can be brought into contact with a heat-transfer device. It is understood that this contact tempering can also be used in addition to the fluid tempering discussed above. For example, contact tempering can be used to cool areas of the mold wall surface which are especially hot.

To achieve the best possible heat transfer between the mold wall surface and the heat-transfer device, it is proposed that the heat-transfer device comprise at least one heat-absorbing and/or heat-supplying body which is designed to fit the contours of the area of the mold wall to be tempered. The heat-absorbing and/or heat-supplying body or bodies can be mounted resiliently on a carrier and/or against one another, which facilitates the equalization of any thermal expansion or contraction of the heat-absorbing and/or heat-supplying bodies.

In a further elaboration of this alternative, it is proposed that the heat-transfer device be made at least partially of a good heat conductor such as copper, a copper alloy, aluminum, an aluminum alloy, etc., at least in the area of the heat-transfer surface.

To be able to supply heat to or to remove heat from the heat-transfer device while it is in contact with the mold wall surface, it is proposed that the heat-transfer device for removing or supplying heat be connected to a heating-cooling machine. In addition or as an alternative, however, it is also possible for the heat-transfer device to be immersed in a heating-cooling bath to supply heat to it or to remove heat from it in preparation for heat-transferring contact.

To produce the heat-transferring contact between the heat-transfer device and the mold wall, the mold can be at least partially closed. The heat-transfer device can be moved into the mold by an industrial robot known in and of itself, preferably a six-axis robot, brought into contact with the mold, and then pulled back out of it again.

Another design variant for supplying heat to or removing heat from the mold is to connect the mold directly to a heating-cooling machine, which allows heat-transfer fluid to flow through a system of channels in the mold.

The temperature of the mold wall can be detected as a possible input variable for the controlled tempering of the mold wall surface. One way in which this can be done is to install a temperature sensor on at least one site which is representative of the temperature distribution of the mold wall and/or which is especially critical in terms of temperature. In addition or as an alternative, the temperature of the mold wall surface can also be measured by means of an infrared measuring device, which supplies digital and spatially resolved thermal images of the mold wall surface which are both time-resolved and also near-instantaneous. If a direct determination of the temperature distribution of the mold wall surface by means of the infrared measuring device is not possible, the distribution can be deduced indirectly by analysis of the thermal images of a molded part just released from the mold. Temperature-critical sites of the molded part can also be brought into contact with a temperature sensor.

The above-described indirect determination of the temperature distribution of the mold wall surface by measurements of a just-finished molded part has the advantage that the infrared measuring device or the temperature sensor can be mounted permanently at a site adjacent to the mold, which means that there is no longer any need for a robot arm to move this measuring device or sensor or in particular to introduce this measuring device into the mold.

Especially when the infrared measuring device discussed above is used, the temperature at a predetermined location on the surface of the mold wall can be detected a predetermined length of time after the opening of the mold and the removal of the molded part. The temperatures specific to time and place thus obtained in successive molding and mold wall treatment cycles can then be compared with each other. In this way it becomes possible to draw conclusions concerning the stability of the overall molding and mold wall treatment operation and to intervene with corrective measures as necessary. For example, if it has been found that the temperature at a predetermined point in time and space is increasing from cycle to cycle, the intensity of the cooling of the mold wall surface can be increased accordingly. If a temperature exceeds a predefined value, it is possible to conclude that there is a defect in the tempering device, and the entire molding process can be stopped to prevent the production of rejects and to avert damage to the mold. A similar type of decision can also be made when the above-discussed volume-rate of flow and/or mass-rate of flow sensor detects that too little mold wall treatment agent is being dispensed.

In addition, the heat balance control strategy explained above can also take into account the ambient temperature, because the outside temperature prevailing at the location of the mold also affects the intensity of the thermal radiation from the mold. The ambient temperature, however, changes with the seasons, for example, and also as a result of changes in exposure to sun light.

In addition, the course of the working or production procedure should also be taken into account, because there is the danger that the mold could cool off too much while the system is idle, in which case the temperature of the mold wall surface would fall below the desired value. The same is also true during the startup of the mold wall treatment system at the beginning of the work day.

When fluid tempering is used, the supply of heat to or removal of heat from the mold wall can be controlled by adjusting the quantity of fluid sup plied per unit time to the mold wall and/or by adjusting the duration of this application. When contact tempering is used, the supply of heat to or the removal of heat from the mold wall can be controlled by adjusting the duration of the heat-transferring contact between the mold wall and the heat-transfer device and/or by adjusting the initial temperature of the heat-transfer device.

The spray element—at least one of which is provided—with centrifugal atomization and air control, which was mentioned briefly above and which will be explained in greater detail further below, can be mounted on a spray tool which introduces it into the mold. When the mold wall surface is tempered with fluid, furthermore, at least one discharge element for dispensing the tempering fluid can also be mounted on this spray tool. In addition, at least one discharge element for dispensing blown air can also be mounted on the spray tool; this air can be used, for example, to clean the mold of treatment agent residues or to blow-dry the mold. Finally, the spray tool can be moved by the arm of a preferably six-axis robot, preferably a program-controlled robot. This has the advantage that the spray tool is highly mobile and can spray every point on the mold wall from a suitable point along its trajectory and with a suitable orientation, so that even mold areas with complicated con tours such as undercuts and recessed areas can be coated with the desired uniformity.

Spray elements with centrifugal atomization and electrostatic control are known from coating technology. Reference can be made merely by way of example to DE 4,105,116 A1, DE 2,804,633 C2, and EP 0,037,645 B1. In this spray technology, high voltage is applied to the spray element during the coating process, whereas the body to be coated is, for example, grounded. The paint supplied to the rotating atomizing element is atomized by the action of centrifugal force, and the fine paint droplets are electrostatically charged simultaneously. Although the paint droplets are flung away by the atomizing element at right angles to the axis of the rotor, the fact that they are charged means that they follow the field lines of the electric field between the spray element and the body to be coated and thus arrive on the surface to be painted. The above-described spray elements with centrifugal atomization and electrostatic control cannot be considered for spraying the walls of a mold for molding or shaping, because the cost of the equipment and of the safety systems required for the use of electrostatic control is so high that it would make the molding or shaping process as a whole uneconomical. In addition, the Faraday effect interferes with the spraying of concave surface areas of the mold wall surface, especially holes, ribs, gaps, etc., such as those which are frequently found in molds for castings such as engine blocks, crankshafts, etc.

It must also be remembered that the spray element is intended to apply essentially solvent-free mold wall treatment agents such as those considered above for the spraying of mold wall surfaces in an accurately measured, finely distributed, and uniform manner onto the mold wall surface. As already mentioned, essentially solvent-free mold wall treatment agents of this type, that is, mold wall treatment agents which contain at least 98 wt. % of substances with lubricating and release properties and no more than 2 wt. % of auxiliary materials such as bactericides, emulsifiers, solvents such as water, etc., usually have a viscosity in the range of about 50–2,500 milliPascal seconds (Brookfield viscometer, 20 rpm) at a temperature of 20° C. and are applied in a quantity much smaller than that used according to the state of the art to the mold wall surface. It must be remembered that the concentrates delivered by producers of mold wall treatment agents usually contain only about 5–40 wt. % of sub stances with lubricating and release properties and is diluted even further before use in a ratio of 1:40–1:200. With the spray element according to the invention, therefore, the volume sprayed per unit time is about 1,000 times smaller than that of the conventional spray elements.

The task of the invention, however, is to provide a spray element for coating the walls of a mold for molding or shaping between two successive molding cycles, that is, a spray element which is able to apply to the mold wall surface even an essentially solvent-free, viscous mold wall treatment agent in a layer thickness suitable for the next molding cycle, this being accomplished under simultaneous preservation of the economic benefit of the molding process.

In spite of the small mold wall treatment agent throughput, the centrifugal atomization used by the spray element according to the invention is able to atomize the agent with the required uniformity over time in a precisely measured fashion. The atomized mold wall treatment agent is then taken up by the control air and deflected from the direction in which it is being propelled, namely, at a right angle to the axis of the rotor, in such a way that it moves essentially in the main spray direction, that is, in the direction of an extension of the rotor axis, toward the mold wall surface. The use of corn pressed air to guide the mold wall treatment agent spray mist has the advantage that this is usually already available in systems for molding or shaping and thus does not require any additional investment. This aspect is also of interest in terms of the retrofitting of already existing spray systems with the spray elements according to the invention. In addition, compressed air is a relatively safe medium, with which machine operators and maintenance personnel have long been familiar.

It must be kept in mind, however, that the spray element according to the invention is also suitable for spraying water-diluted mold wall treatment agents and water. The adaptation to the lower viscosity of these materials can be accomplished by, for example, an appropriate choice of the rpm's of the atomizing element and by appropriate adjustment of the control air throughput.

To be able to ensure that the mold wall treatment agent spray mist leaving the atomizing element is entrained as completely as possible by the control air, the outlet of the control air feed line can, in accordance with a first alternative design variant, comprise a plurality of outlet openings arranged in a circle around the atomizing element. According to a second alternative design variant, the outlet of the control air feed line can comprise an outlet slot forming a circle surrounding the atomizing element. To be able to ensure that the pressure of the control air is as uniform as possible in the circumferential direction, it is proposed that the control air feed line include a ring-shaped channel upstream of the outlet slot.

To adjust the included angle of the spray cone, it can be provided, for example, that the control air feed line is formed at least in part by a head part of the spray element body, which is movable relative to a base part of the spray element body, such as by means of a preferably program-controlled servo drive. The boundaries of the ring-shaped channel can be formed on the radially outward side by the head part and on the radially inward side by the base part or by an element connected to the base part.

So that the control air can be ejected in a jet-like, controlled manner, the control air feed line can be designed with a taper near the outlet end, tapering down in the outlet direction of the control air.

A drive unit for producing the rotational movement of the rotor around its axis of rotation can comprise, for example, a turbine operated with corn pressed air, which represents a low-cost design variant, because compressed air is being supplied in any case to the spray element as control air. Alternatively, the drive unit can also be an electric motor or some other suitable type of rotary drive. The drive unit can be mounted in a housing which is separate from the base of the spray element body and which can be attached to the base. This facilitates accessibility for maintenance, for example.

The atomizing element can form a single unit with the rotor, or it can be connected detachably to it by means of, for example, quick-release devices.

In accordance with a first alternative design variant, it can be provided that the atomizing element has an atomizing surface facing the mold wall surface. It is advantageous for the atomizing surface to extend radially outward and away from the spray element in the direction of rotation, in such a way that the atomizing surface forms a cone, where half the included angle of the cone is, for example, between about 30° and 60°, preferably about 45°. An atomizing surface with this design is advantageous, because the mold wall treatment agent is thus pressed by the centrifugal forces acting on it against the atomizing surface and can be effectively atomized by it under the effects of friction. The atomizing element can thus, for example, have an atomizing funnel opening in the direction of the mold wall surface, the inside surface of the funnel acting as the atomizing surface.

So that the mold wall treatment agent can be discharged in the most uniform possible manner onto the atomizing surface, it is proposed that the atomizing surface be preceded by a distribution chamber. This distribution chamber can have an opening near the axis of rotation and extending around the axis of rotation, through which mold wall treatment agent is introduced; and a distribution chamber boundary surface, which extends radially outward, pointing away from the direction/plane of rotation, can adjoin the outer circumferential edge of the opening. The distribution chamber boundary surface can be conical, for example, where half the included angle of the cone can be, for example, between about 20° and about 60°, preferably about 45°.

The mold wall treatment agent introduced into the distribution chamber through the radially inward opening is forced radially outward by the centrifugal forces acting on it in the chamber; the boundary surface of the distribution chamber prevents the re-emergence of the mold wall treatment agent from the distribution chamber and thus protects the spray element from contamination. Distribution passages, which lead from the distribution chamber to the atomizing surface, can be provided in the area of this radially outward holding space, which is at least partially defined by the distribution chamber boundary surface, that is, in the peripheral area of the distribution chamber remote from the axis of rotation. These distribution passages can be simple holes or slots to minimize the cost of fabricating the atomizing element. In terms of production technology, it is also favorable for these holes or slots to extend in the radial direction. In principle, however, it is also conceivable that the holes or slots could be at a predetermined angle to the radial direction. By the use of appropriate methods to fabricate the atomizing element, the distribution passages can also be curved, so that an effect comparable to that of guide vanes is obtained.

If the outer peripheral edge of an element forming the boundary between the distribution chamber and the mold wall projects in the radial direction beyond the radially outer edge of the distribution passages and is mounted a certain distance away from the atomizing surface, it is possible to offer the distribution passages a certain protection from damage. In addition, the atomizing element as a whole obtains an attractive outer appearance.

In particular, however, the gap present in the above design between the atomizing surface and the element forming the boundary between the distribution chamber and the mold wall has another advantageous effect. If the atomizing element is running empty, that is, without any mold wall treatment agent being supplied to it, the air enclosed in this gap is propelled radially outward by centrifugal force so that a negative pressure, which draws air out from the distribution chamber, is created in the area of the outlet of the distribution passages. Overall, therefore, what develops is a blower-like effect, which ultimately leads to the self-cleaning of the atomizing element after the coating of the mold wall surface has been completed.

After the mold wall treatment agent has been introduced into the distribution chamber, its movement into the distribution passages can be facilitated by providing a rounded transition from the cylindrical boundary surface of the distribution chamber, which is essentially coaxial to the axis of rotation, to the boundary surface of the distribution chamber, which extends essentially at a right angle to the axis of rotation. This is important especially as a way of ensuring the completeness of the above-mentioned self-cleaning of the atomizing element.

The atomizing element according to the first alternative design variant of the invention discussed above can be designed as a single piece or as several pieces. In the latter case, the individual parts of the atomizer element can be joined together by pressing, flanging, or the like.

In accordance with a second alternative design variant, the atomizing element can comprise an atomizing disk.

So that maximum advantage of the centrifugal effect of the atomizing element can be taken, it is proposed that the mold wall treatment agent emerging from the mold wall treatment agent feed lines strike the atomizing element near its axis of rotation.

If the spray element comprises a plurality of mold wall treatment agent feed lines, the area of the mold wall which require special treatment can be coated separately with one or more mold wall treatment agents. It is also possible, however, to coat the entire mold wall treatment agent with a multi-layer coating of various mold wall treatment agents. Mixed layers can also be applied by the simultaneous discharge of mold wall treatment agent from at least two of the mold wall treatment agent feed lines.

For the spraying of concave mold wall sections such as holes as well as ribs and gaps, it can be advantageous to provide a device for deflecting the main discharge direction of the spray element out of the extension of the axis of rotation of the rotor. There are many different design variants which could be used to realize such a deflecting device. For example, the deflecting device can be a device for changing the number and/or diameter of outlet openings and consist, for example, of a diaphragm ring. As an alternative, however, it is also possible for the deflecting device to be a device for changing the width of the outlet slot, and consist again, for example, of a diaphragm ring. But it is also possible to provide a plurality of control air feed lines, the air throughput of which can be adjusted independently of each other. In this case, the deflecting effect is achieved by appropriate adjustment of the air throughput through the majority of feed lines to different values. Finally, it is also possible for the deflecting device to consist of at least one deflecting air feed line; that is, an additional deflecting air feed line is provided, which is "turned on" as needed.

As a further elaboration of the invention, it is provided that the thickness of the layer of mold wall treatment agent applied to the mold walls can be controlled, preferably in a program-controlled manner. The thickness of the applied layer can, for example, by controlled by adjusting the speed at which the spray element travels and/or by adjusting the quantity of mold wall treatment agent discharged per unit time by at least one spray element.

From a different viewpoint, the invention pertains to the use of a spray element according to the invention as part of, if desired, a mold spray device according to the invention and also, if desired, within the scope of the implementation of the above-described mold wall treatment process according to the invention for spraying the walls of a mold for molding or shaping with an essentially solvent-free mold wall treatment agent. The advantages of this use can be derived from the discussion given above.

Mold 12 comprises two halves 12*c*, 12*d*, one of which, i.e., 12*c*, is attached to a clamping plate 14*a*, which can move in the direction of double arrow F, while the other half is attached to a stationary clamping plate 14*b*. Thus, mold 12 can be closed to form a closed mold cavity 16 and opened again for the removal of a molded part (not shown). In the die-casting process discussed here by way of example, mold 12 is closed, and then mold cavity 16 is filled with liquid metal through a feed line 18. After the molded part has hardened completely and mold 12 has been opened, the part is removed from mold 12 and carried away. Although, in FIG. 1, only two clamping plates 14*a*, 14*b* with two mold halves 12*c*, 12*d* are shown, it is also possible, of course, for molds consisting of more than two parts to be used.

To prepare mold 12 for the next molding cycle, mold wall surfaces 12*a*, 12*b* must first be brought to a temperature favorable for the next molding cycle. Because the liquid metal which fills mold cavity 16 transfers its heat to mold 12 as it solidifies, it will usually be necessary to cool mold wall surfaces 12*a*, 12*b* to bring them to the temperature suitable for the next molding cycle, because the cooling which occurs merely by thermal radiation is not sufficient. Nevertheless, it can also happen that, in the case of interruptions in the continuous production of molded parts or in the production of very finely divided molded parts consisting of a relatively small amount of liquid metal, mold walls 12*a*, 12*b* will have to be heated to bring them to a temperature favorable for the following molding cycle.

Second, mold walls 12*a*, 12*b* must be coated with the most uniform possible layer of a mold wall treatment agent. This mold wall treatment agent has the job, first, of lubricating the ejector, not shown in FIG. 1, which ejects the solidified part from mold 12, and, second, the job of preventing the introduced metal from welding or sticking to the mold material and of preventing the premature solidification of the introduced metal and thus of helping to achieve castings of the desired quality. Under certain conditions, it can also be necessary to clean molds walls 12*a*, 12*b* of residues of mold wall treatment agent or of metal, which can be done, for example, with compressed air, before the walls are tempered and coated.

In contrast to the state of the art, the tempering of mold 12 and the coating of mold walls 12*a*, 12*b* with mold wall treatment agent are carried out according to the invention in separate steps, that is, steps which do not overlap in time. In the exemplary embodiment shown in FIG. 1, however, both steps are carried out by one and the same mold spray device 10 under the control of a control unit 20, shown in FIG. 2.

Mold spray device 10 comprises a spray tool 22 with a plurality of spray or blowing elements 24, 26, 28, which is inserted by a six-axis industrial robot 30 between opened mold halves 12*c*, 12*d*, moved at a desired speed v along a desired path B, and finally pulled back out of mold 12. During this procedure, spray tool 22 can be brought by robot 30 into any desired orientation in space at any point along path B.

The design and function of industrial robot 30 are known in and of them selves and are therefore not explained in any greater detail here.

In the illustration according to FIG. 1, three different possibilities by means of which mold wall surfaces 12*a*, 12*b* can be brought to the temperature suitable for the next molding cycle are shown:

First, a heating-cooling unit 32 is provided, which supplies a heating-cooling fluid, preferably a heating-cooling liquid, via feed line 32*a* to a system of channels 12*e* inside mold 12. By means of heating-cooling unit 32, heat can be removed from or supplied to mold 12 even while the liquid metal is solidifying in mold cavity 16. Ideally, this "internal" tempering should be the only measure used to bring the mold to the desired temperature, because, in comparison with the "external" tempering processes discussed further below, it causes the least thermal stress on the mold material and thus the least amount of mold wear as a result of alternating temperature stresses. This "internal" tempering can begin as soon as the metal introduced into mold cavity 16 starts to solidify, whereas, in the case of "external" tempering, the process cannot begin until after mold halves 12*c*, 12*d* have been opened and the finished molded part has been removed from the mold.

If the "internal" tempering of the mold described above is not sufficient for technical reasons associated with production or for economic reasons, mold 12 can also be tempered externally. This can be done, for example, in that, by means of spray tool 22, a cooling fluid, preferably demineralized water, is sprayed onto mold wall surfaces 12*a*, 12*b* through spray nozzles 24 and allowed to evaporate from the surfaces. The use of demineralized water offers the advantage that lime deposits on mold wall surfaces 12*a*, 12*b*, which could impair the quality of the layer of mold wall treatment agent to be applied next, are avoided. Spray nozzles 24 can, for example, be designed in the manner described in DE 4,420,679 A1. To accelerate the cooling process, more cooling liquid will often be applied than can evaporate spontaneously from hot mold surfaces 12*a*, 12*b*. The excess water which drips down is collected in a collecting tray 34. Coarse particles present in the excess water are retained by a filter unit 36. Next, the collected water is sent through a line 36*a* to a purification device 38, in which it is cleaned of oil films, suspended matter, etc., by means of, for example, centrifuging, settling, sedimenting, etc. The purified water is then sent through a line 38*a* to a tank 40 for reuse by spray device 10. A line 40*a*, furthermore, is used to supply fresh, demineralized water, so that a sufficient supply of cooling water can always be made available to spray device 10 through line 40*b*.

It should be appended that, for the operation of the spray elements according to DE 4,420,679 A1, not only the liquid to be sprayed but also blown air are required. This air is supplied to mold spray system 10 through a corn pressed air line 42. The supply lines running along robot arm 30 for compressed air, tempering fluid, and mold wall treatment agent have been omitted from the drawing shown in FIG. 1 for the sake of the clarity.

Another possibility for external tempering consists in bringing a heat-transfer device 44 into contact with mold wall surfaces 12*a*, 12*b* or with an area 12*f* of this mold wall surface which requires special cooling. For this purpose, the heat-transfer device comprises a carrier body 44*a* and at least one heat-transfer body 44*b*, guided along the carrier and in good thermal con tact with it. Surface 44*c* of the heat-transfer body is designed to conform to area 12*f* of mold wall surface 12*a*, 12*b* to be tempered. Heat-transfer device 44 can, for example, be moved by means of an additional industrial robot, not shown in FIG. 1, if required, between mold halves 12*c*, 12*d* and brought into contact with mold wall surfaces 12*a*, 12*b*.

To prevent damage either to heat-transfer device 44 or to mold 12 and at the same time to guarantee good heat-transferring contact between heat-transfer body 44*b* and area 12*f* of mold 12 to be tempered, heat-transfer body 44*b* is cushioned on carrier 44*b* by means of a spring 44*d*. So that heat can be supplied to or removed from heat-transfer body 44*b*, a system of fluid channels 44*e* is provided in carrier 44*a*, which can be connected in turn to heating-cooling unit 32. Another possibility of supplying heat to heat-transfer device 44 or of removing heat from it consists in immersing it into a heating-cooling bath 46 in preparation for the tempering process.

In all three of the possibilities for tempering mold 12 discussed above, it is desirable to remove only just enough heat from or to supply only just enough heat to the mold as is necessary to reach the temperature which is favorable for the next molding cycle. The operation of heating-cooling unit 32, the movement of spray tool 22 between opened mold halves 12*c*, 12*d*, the ejection of the cooing liquid from spray elements 24, the duration of the con tact between heat-transfer device 44 and mold wall surfaces 12, 12*b*, etc., are therefore carried out under the control of a control unit 20 on the basis of at least one the sensor signals discussed below:

For example, the temperature of mold 12 can be monitored continuously by a temperature sensor 48, which is installed at a point which is representative of the temperature distribution in mold 12. According to FIG. 2, temperature sensor 48 transmits a mold temperature signal $T_F$ to control unit 20. If desired, several of these mold temperature sensors can be provided.

The temperature distribution of mold wall surfaces 12*a*, 12*b* can also be determined, however, by means of a thermal image recording device 50, which transmits a corresponding digital, spatially-resolved temperature signal $T_F$ to control unit 20. Thermal image recording device 50 can be permanently installed, or it can be brought into the most favorable position for recording the thermal image by a pivoting device or by a robot arm. Another variant consists not in determining the heat distribution of mold wall surfaces 12*a*, 12*b* directly but rather in determining them indirectly from the thermal image of a molded part just after it has been removed from the mold.

To take into account the temperature fluctuations in the area of the production plant, which vary with the seasons, for example, or which are the result of exposure to sunlight, and which can also have an effect on the temperature of the mold wall surface, control unit 20 can also accept as input a temperature signal $T_U$ from an ambient temperature sensor for the sake of con trolling the tempering process.

In addition, data A on the work procedure can also be of interest with respect to the control of the tempering step. For example, an interruption in the production cycle can lead to the complete cooling-down of mold 12, which means that the mold must first be heated when production is started up again and then cooled later as production gets into full swing. Information such as this on the course of production can be made available to control unit 20 by a suitable data storage unit 54, which is indicated merely by way of example in FIG. 2 by the schematic symbol for a tape-recording machine.

From the signals $T_F$, $T_F$, $T_U$, and A, and, if desired, from additional sensor signals, a temperature controller 20*a* of control unit 20 determines output signals for industrial robot 30, which moves spray tool 22, especially the trajectory, position, and speed of movement of the tool; operating signals for spray elements 24 or the devices which serve these spray elements such as pumps and valves for the supply of cooling liquid from tank 40 and pumps and valves for the supply of blown air from compressed air line 42; operating signals for heating-cooling unit 32; and operating signals for heat-transfer device 44.

After mold wall surfaces 12*a*, 12*b* have been tempered, spray tool 22, specifically spray elements 26, can now coat tempered mold wall surfaces 12*a*, 12*b* with mold wall treatment agent. According to the invention, an essentially solvent-free mold wall treatment agent is used, which is able to wet mold wall surfaces 12*a*, 12*b* even at the temperature favorable for the next molding cycle, namely, at temperatures in the range of 350–400° C., and to form on these surfaces a film with lubricating and release properties with a thickness of about 5–10 μm. The expression "essentially solvent-free mold wall treatment agent" is understood to mean a mold wall treatment agent which contains at least 98 wt. % of substances with lubricating and release properties and no more than 2 wt. % of auxiliary materials such as bactericides, emulsifiers, solvents, and the like.

The mold wall treatment agent is made available in a ready-to-use consistency in transport containers 56, 58, which are connected directly to spray device 10, and from which the mold wall treatment agent is supplied directly to spray elements 26, that is, without any previous dilution with water or other solvent. The agent is taken from the containers by a compressed air-operated removal device 64. This direct, undiluted removal offers the advantages that, first the cost of acquiring and maintaining a dilution system can be saved, and, second, that the danger associated with dilution of attack by bacteria or fungi can be almost completely excluded. The provision of two transport containers 56, 58 offers the additional advantage that, after one container 56 has been completely emptied, the system can be switched over either automatically under the control of control unit 20 or manually to removal from the other container 58, without any need to interrupt production operations to do it. Instead, empty container 56 can be replaced with a new transport container filled with mold wall treatment agent as operations continue uninterruptedly.

This coating process is also carried out under the control of control unit 20. According to FIG. 2, the trajectory, the speed, and the position of spray tool 22, that is, the operation of industrial robot 30, and the amount of mold wall treatment agent discharged per unit time by spray elements 26 are controlled by a coating controller 20*b* of control unit 20. To ensure that, at every point of trajectory B of spray tool 22, an amount of mold wall treatment agent adequate to the speed and position of the spray tool is applied to mold wall surfaces 12*a*, 12*b*, that is, to guarantee that the entire mold wall surface 12*a*, 12*b* is coated with the most homogeneous possible, uniform layer of mold wall treatment agent, a discharge rate sensor 60 is provided in spray tool 12, such as a volume-rate of flow measuring device or a mass-rate of flow sensor, which transmits a corresponding throughput signal V to control unit 20. Of course, it is preferred for each spray element 26 to have its own separate flow rate sensor 60. On the basis of the detection signals of these flow rate sensors 60, it possible for control unit 20 and its coating controller 20*b* to achieve the automatic control of the layer thickness.

As already explained above, spray tool 22 also comprises blast nozzles 28 for discharging compressed air. This compressed air can be used, for example, after removal of the most recently finished molded part and before tempering to clean mold 12 of residues of metal and treatment agent and/or to blow-dry the mold before the walls are coated with mold wall treatment agent. This blown air cleaning or drying can also be accomplished under the control of control unit 20.

Figure 2:
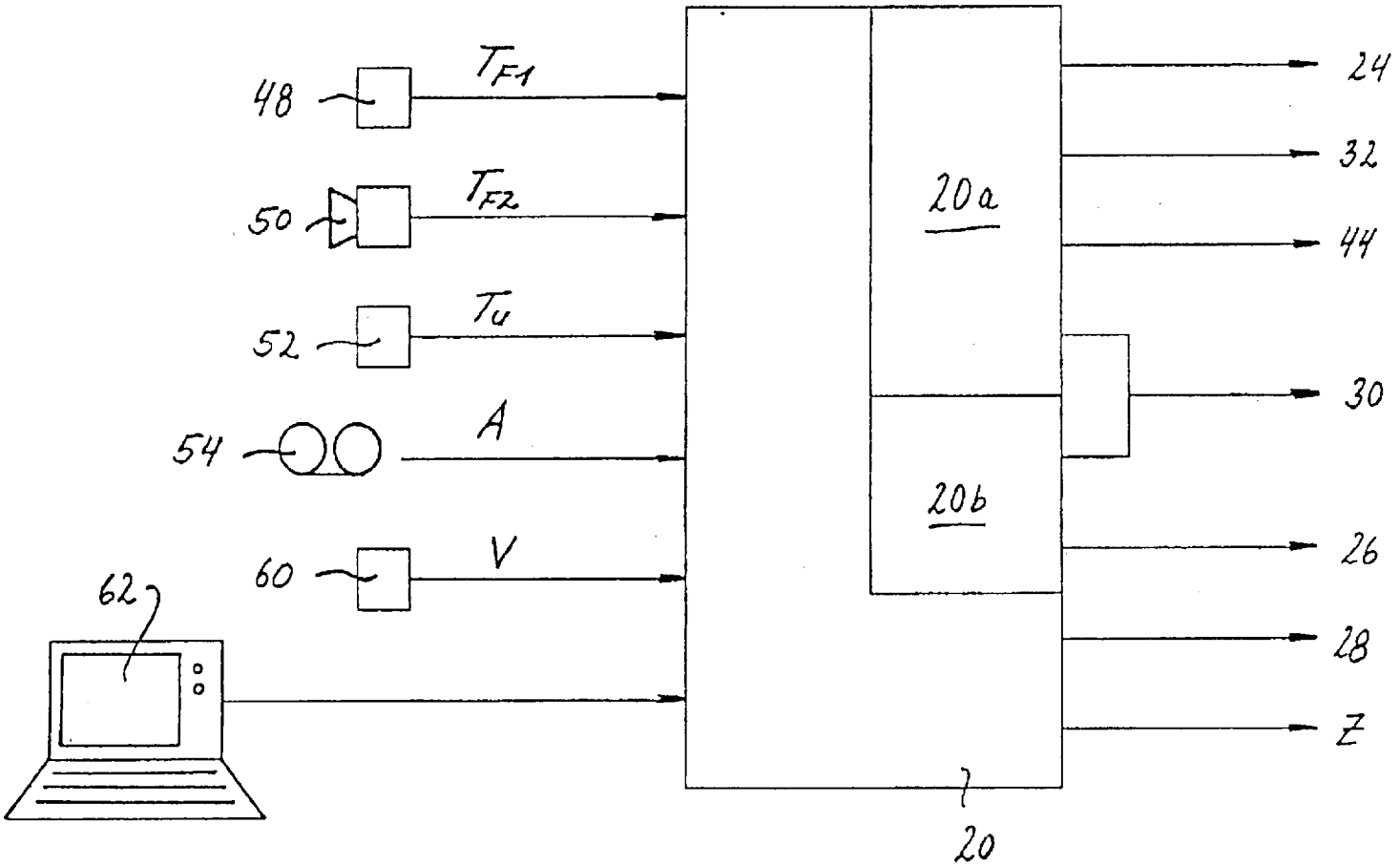
FIG. 2 shows a rough schematic diagram of the control unit for con trolling the mold spray system according to FIG. 1.

It should be added that control unit 20 also can take over other control tasks, such as the control of the opening and closing of mold halves 12*c*, 12*d*, the removal of the molded part from mold 12 as soon as it is finished, and similar control tasks which may occur, as indicated in summary in FIG. 2 by reference letter Z.

The point to be remembered is that the operation of production plant 10 can proceed in a program-controlled manner. Control unit 20 is connected to a data input/output terminal 62 so that control programs of this type can be entered and called up.

Deviations from predetermined nominal temperatures can be detected at any point of the molding cycle by means of the above-described control system, whereupon the control program can be adjusted on the basis of appropriate data or by means of an appropriate software program, which preferably runs automatically. Thus, the thermal equilibrium most favorable in terms of the process technology can always be maintained within narrow tolerances in any situation. This has an advantageous effect on the quality of the finished molded parts.

Figures 3, 4:
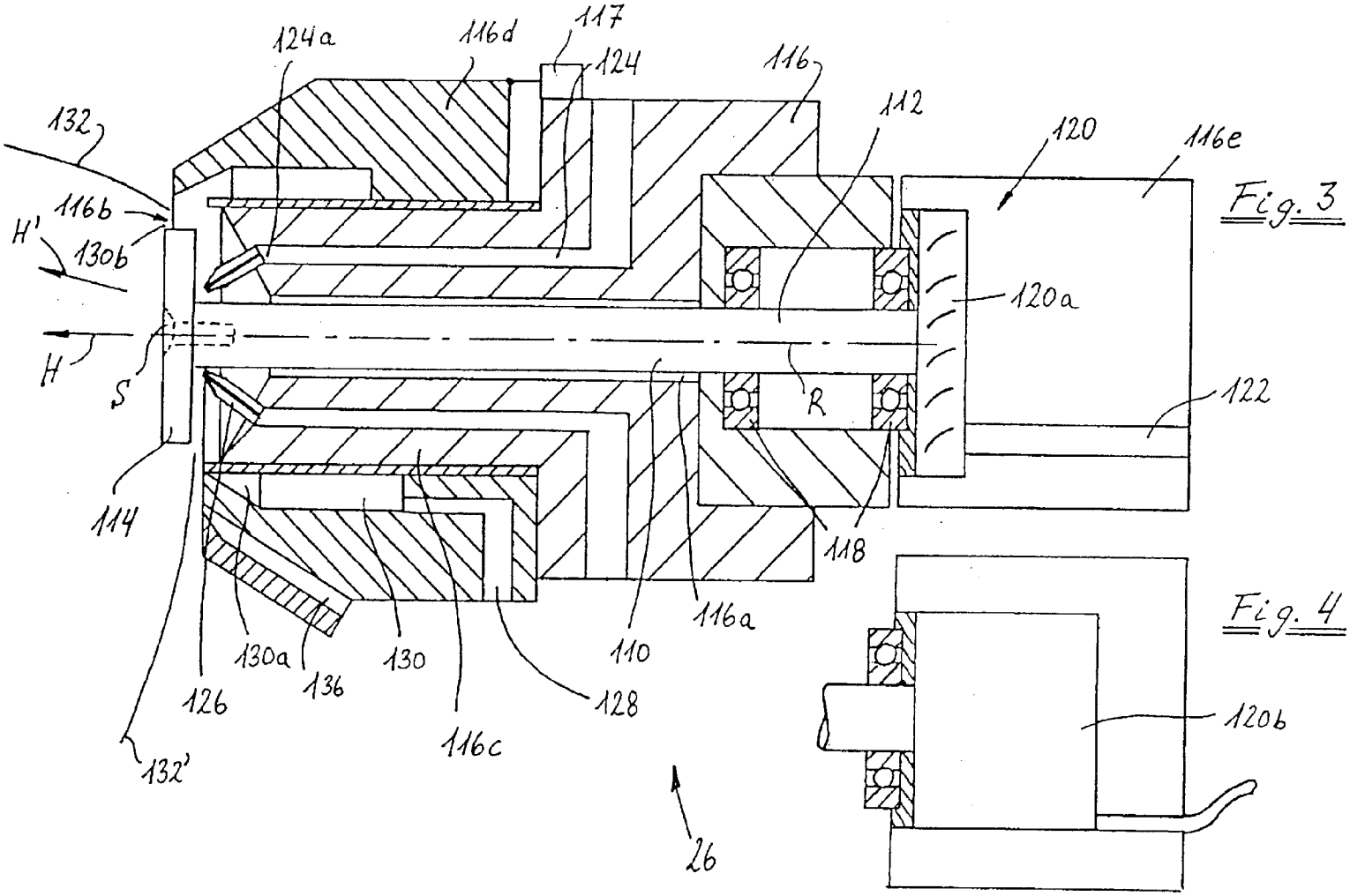
FIG. 3 shows a cross-sectional side view of a spray element according to the invention with centrifugal atomization and air control.
FIG. 4 shows an alternative design of the drive unit for the spray element according to FIG. 3.

FIG. 3 shows in detail a spray element 26 for spraying mold wall treatment agent. Spray element 26 is designed to spray essentially solvent-free mold wall treatment agent with high-temperature wetting properties. Mold wall treatment agents of this type, i.e., agents which contain at least 98 wt. % of substances with lubricating and release properties and no more than 2 wt. % of auxiliary materials such as bactericides, emulsifiers, solvents, etc., and which are able to wet a mold wall surface with a temperature of, for example, 350–400° C. and to form on it a uniform layer of mold wall treatment agent has a viscosity at 20° C. approximately in the range of 50–2,500 milliPascal seconds (measured with a Brookfield viscometer at 20 rpm).

Spray element 26 comprises a rotor 110 with a rotor shaft 112, turning around an axis of rotation R, and an atomizing disk 114, which is designed to constitute a single part with the shaft or which is fastened to the shaft (see screw S, indicated schematically). Rotor 110 is held with freedom of rotation around axis of rotation R in a base body 116 of the spray element, or, more precisely, in a shaft passage 116*a* in this base body 116; a bearing assembly 118 makes it possible for rotor 110 to rotate. At the end of rotor shaft 112 opposite atomizing disk 114, a drive unit 120 is provided, which drives rotor 110 at a speed on the order of approximately 10,000 rpm to approximately 40,000 rpm.

In the embodiment according to FIG. 3, drive unit 120 is formed by a compressed-air turbine 120*a*, which is supplied with compressed air through a compressed-air feed line 122. Compressed-air turbine 120*a* and compressed-air feed line 122 are installed in a housing 116*e*, indicated merely schematically in FIG. 3, which is attached to base part 116*a* in a detachable manner, which offers the advantage of easier maintenance. According to the design variant shown in FIG. 4, drive unit 122 can also be an electric motor 120*b*. Compressed-air turbine 120*a* has the advantage that the compressed air required to drive it, as will be seen from the following discussion, must be supplied in any case to spray element 26, whereas, in the case of an electric motor 120*b*, the additional work of laying an electric power line to spray element 26 is required.

In base body 116, a first feed line 124 is provided, which leads to the front end 116*b* of the body. A nozzle body 126, which discharges mold wall treatment agent supplied through feed line 124 to atomizing disk 114, that is, to the area near where the disk is connected to rotor shaft 112, is inserted into orifice 124*a* at the front end of this feed line 124. The mold wall treatment agent coming into contact with atomizing disk 114 is flung outward at right angles to axis of rotation R as a result of the rotation of the disk and thus finely atomized. The atomizing effect can be reinforced by impact ribs, not shown, which extend in the radial direction with respect to axis of rotation R.

A head part 116*d* is supported with freedom of movement in the direction of axis of rotation R on a cylindrical section 116*c* of base part 116. For example, a rotationally symmetric head part 116*d* can be screwed to cylindrical section 116*c*. It is also possible, however, for head part 116*d* to be moved by an servo drive in the direction of axis of rotation R under the control, for example, of control unit 20, which may be program-controlled. A compressed-air feed line 128, which opens out into a ring-shaped channel 130 near the front end 116*b* of spray element body 116, is provided in this head part 116*d*; at the end 130*a* of the ring-shaped channel, the channel tapers down toward axis of rotation R of the rotor and terminates there in a ring-shaped outlet slot 130*b*. In the exemplary embodiment according to FIG. 3, ring-shaped channel 130 is bounded on the radially outward side by head part 116*d* and on the radially inward side by cylindrical section 116*c*. Ring-shaped channel 130 serves to equalize the pressure of the compressed air supplied through feed line 128 and present at outlet slot 130*b*.

The compressed air discharged through outlet slot 130*b* deflects the atomized mold wall treatment agent which has been flung radially outward from axis of rotation R. This has the result of producing a spray cone 132, which opens out in main spray direction H, defined by the extension of axis of rotation R. By shifting the position of head part 116*d* in the direction of axis of rotation R, the width of outlet slot 130*b* and thus the amount of control air discharged through this outlet slot 130*b* can be varied. Thus, in FIG. 3, a very wide outlet slot is shown at the top, from which a large amount of control air is discharged, whereas, at the bottom of FIG. 3, a very narrow outlet slot is shown, from which only a very small amount of control air emerges. The larger the amount of compressed air being discharged through outlet slot 130*b*, however, the greater the entrainment effect which this corn pressed air exerts on the atomized mold wall treatment agent and the smaller the included angle of the spray cone. In the same way, a very narrow spray cone 132 is obtained when head part 116*d* is in the position shown at the top of FIG. 3, whereas a very wide spray cone 132' is obtained when head part 116*d* is in the position shown at the bottom of FIG. 3.

It should also be pointed out that a plurality of feed lines 124 for mold wall treatment agent can also be provided, through which, according to a first alternative, one and the same mold wall treatment agent is supplied or through which, according to a second alternative, different mold wall treatment agents can be supplied for discharge through spray element 26.

For example, for the coating of concave mold areas such as holes, ribs, gaps, etc., it can be advantageous to deflect spray jet 132 sideways out of main spray direction H defined by the extension of axis of rotation R, as indicated in FIG. 3 by arrow H'. For this purpose, for example, an additional feed line 136 for deflecting air can be arranged on or designed into head part 116*d* of spray element body 116.

It is also possible, however, to provide a plurality of control air feed lines 128 distributed around the periphery of head part 116*d*, the control air throughputs of which can be controlled independently of each other. These can either open out directly at the discharge end of spray element body 116 or, in analogy to the embodiment according to FIG. 3, they can open out into a ring-shaped channel, in which case the length of this channel must be made so short that the pressure cannot equalize in the circumferential direction or at least so that it cannot equalize completely by the time the air reaches outlet slot 130*b*.

Figure 6:
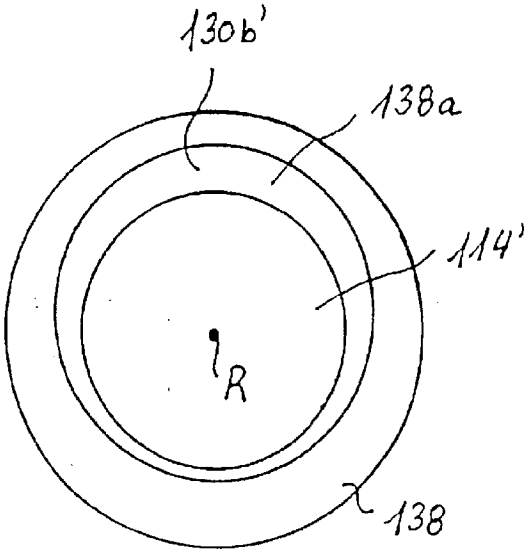
FIG. 6 shows a front-end view of the design according to FIG. 4 in the direction of arrow VI in FIG. 5.
Figure 5:
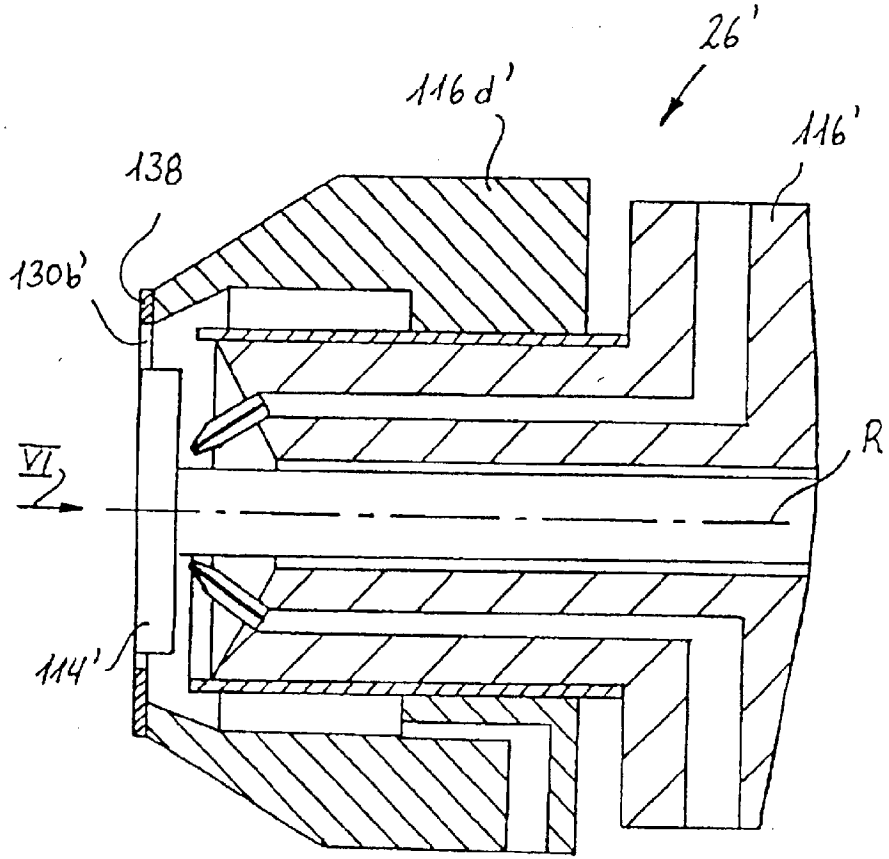
FIG. 5 shows a view, similar to that of FIG. 3, of the discharge end of an alternative design of the spray element according to FIG. 3.

Another design alternative is illustrated in FIGS. 5 and 6. In this spray element 26', a diaphragm disk 138 with a circular cross section and a circular, disk-shaped diaphragm opening 138*a*, arranged eccentrically with respect to axis of rotation R, is provided on head part 116*d'* of spray element body 116'. Diaphragm opening 138*a* is dimensioned in such a way that an outlet slot 130*b'*, the width of which varies in the circumferential direction, is formed between atomizer disk 114' and diaphragm 138. Thus, outlet slot 130*b'* at the top in FIG. 5 has the maximum width, whereas at the bottom of FIG. 5 it has the minimum width. As a result, more control air emerges from the slot at the top of FIG. 5, which leads to a corresponding increase in the entrainment effect on the atomized mold wall treatment agent and thus overall to a downward deflection of the spray cone in FIG. 5.

Diaphragm 138 can be attached to head part 116*d'* in such a way that it can be rotated in the circumferential direction to vary the direction in which the spray cone is deflected. It can also be designed in such a way that it can be moved in the radial direction with respect to axis of rotation R, so that the eccentricity of its arrangement with respect to atomizing disk 114' can be varied. Finally, diaphragm 138 can be designed as an iris diaphragm, so that the diameter of the diaphragm opening and thus the width of diaphragm gap 138*a* can be varied.

Figure 7:
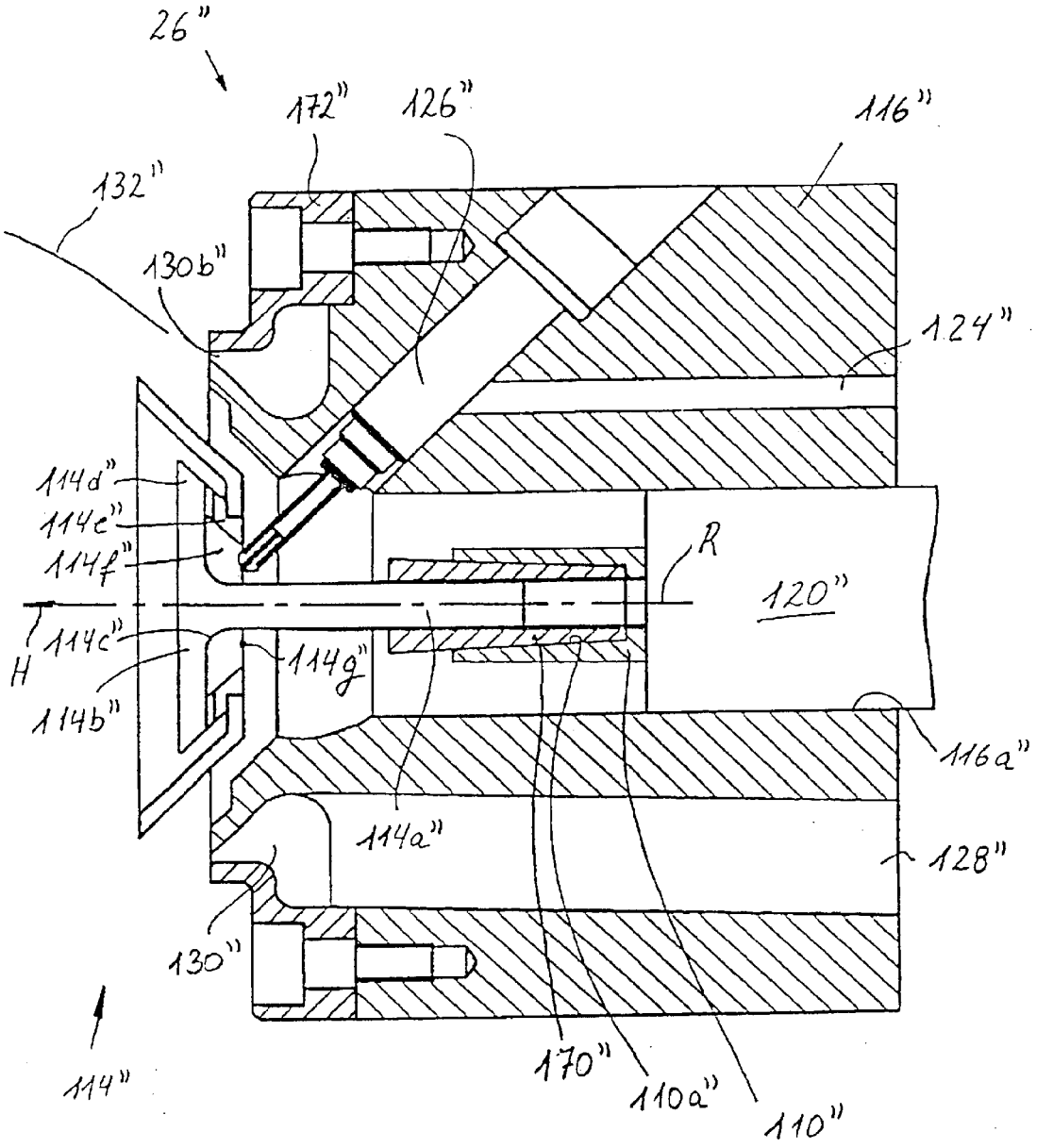
FIG. 7 shows a view, similar to that of FIG. 3, of a part of another alternative embodiment of the spray element according to the invention.
Figure 8:
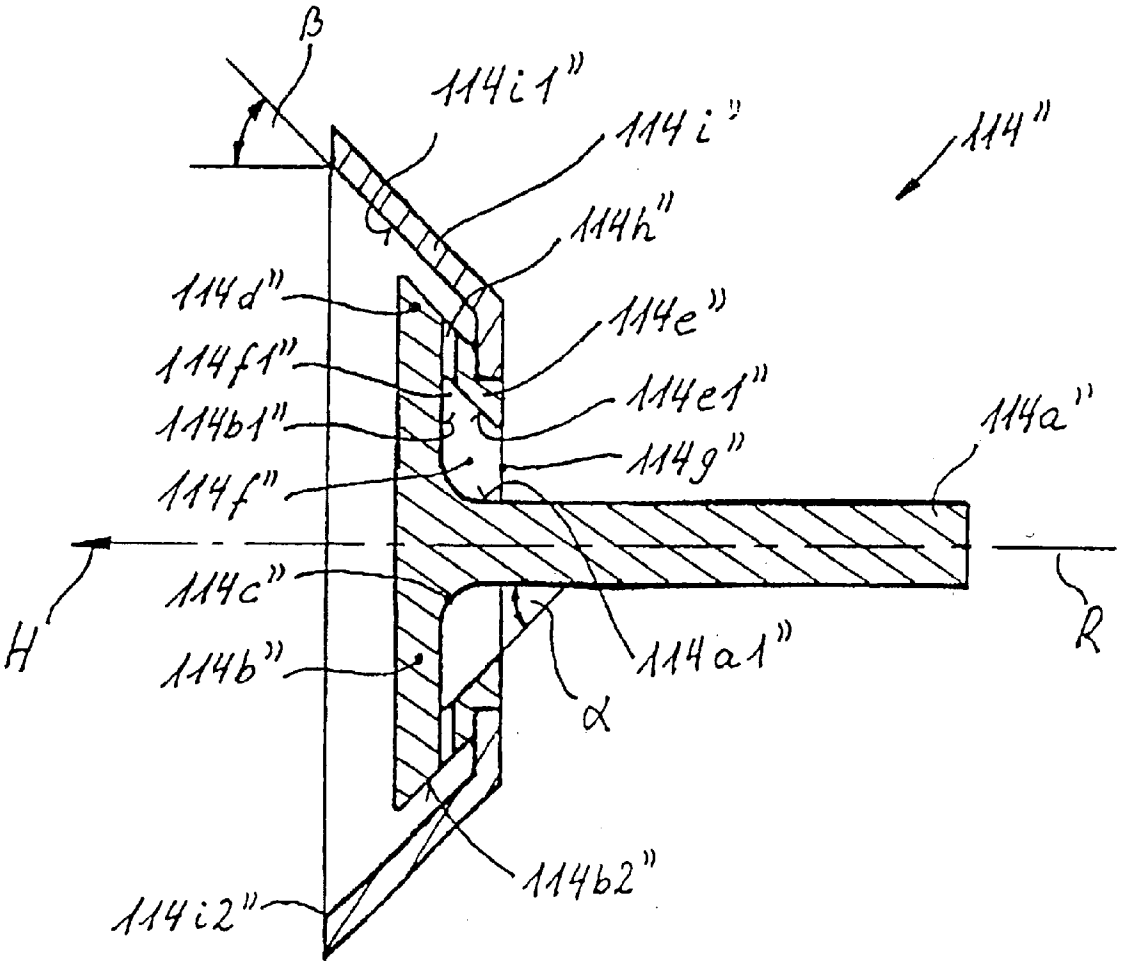
FIG. 8 shows a detailed view of the atomizing element of the design according to FIG. 7.

FIGS. 7 and 8 show part of another embodiment of a spray element 26" according to the invention, which corresponds essentially to that of the illustration according to FIG. 3. Therefore, analogous parts in FIGS. 7 and 8 are provided with the same reference numbers as those used in FIG. 3, except that a double stroke is added. In addition, spray element 26" according to FIGS. 7 and 8 is described in the following only to the extent that it differs from spray element 26 according to FIG. 3. To the extent that the elements are the same, explicit reference is herewith made to the description the previous element.

In the case of spray element 26" according to FIG. 7, drive unit 120" is inserted into a central passage 116"[116*a*"—Tr. Ed.] in base body 116" and fastened there by means of appropriate devices (not shown). A driver element 110" of drive unit 120" comprises a recess 110*a*", in which shaft 114*a*" of atomizing element 114" is held non-rotatably by a screw-in taper element 170". This taper type of mount is a quick-release connection known in and of itself.

As illustrated in detail in FIG. 8, a disk element 114*b*", essentially at a right angle to axis of rotation R, is integrally connected to the end of shaft 114*a*" pointing in main spray direction H. The transition 114*c*" between shaft 114*a*" and disk 114*b*" is rounded. At the radially outward end 114*d*" of disk 114*b*", a ring-shaped shoulder 114*e*" is provided, which extends in the direction opposite the main spray direction H, that is, toward spray element 26". Inner circumferential surface 114*e*1" of ring-shaped shoulder 114*e*", a part of cylindrical surface 114*a*1" of shaft 114*a*", rounded area 114*c*", and a boundary surface 114*b*1" of disk 114*b*" extending essentially at a right angle to axis of rotation R together form the boundaries of a distribution chamber 114*f*', into which the mold wall treatment agent can be introduced from nozzle element 126" through opening 114*g*" adjacent to shaft 114*a*" (see FIG. 7).

Because of the centrifugal forces acting on it, the mold wall treatment agent moves along rounded area 114*c*" and boundary surface 114*b*1" to outer circumferential edge 114*f*1" of distribution chamber 114*f*' or is flung to boundary surface 114*e*1" of ring-shaped shoulder 114*e*". In the exemplary embodiment illustrated here, this boundary surface 114*e*1" is conical, where half the included angle $\alpha$ of the cone is approximately 45°. The cone expands in spray direction H, so that mold wall treatment agent striking area

114*e*1" is pushed by centrifugal forces toward outer circumferential edge 114*f*1" of distribution chamber 114*f*".

At outer end 114*f*1" of distribution chamber 114*f*', radial distribution passages 114*h*" are provided, through which the mold wall treatment agent can emerge from distribution chamber 114*f*' and thus arrive on atomizing surface 114*i*1" of a funnel element 114*i*", connected by a press-fit to ring-shaped shoulder 114*e*". Atomizing surface 114*i*" is designed as a conical funnel surface opening in spray direction H, where half the included angle β of this funnel surface in the present exemplary embodiment is approximately 45°. The form of surface 114*i*1" expanding in spray direction H has the advantage that the mold wall treatment agent is forced by the centrifugal forces acting on it against atomizing surface 114*i*1", where it is finely atomized by centrifugal force, which increases with increasing radius, and by friction with atomizing surface 114*i*1". After passing break-off edge 114*i*2", the atomized mold wall treatment agent is flung radially outward, before it is captured by the air emerging from outlet gap 130*b*" and carried along as spray cone 132" to the mold wall.

It should be pointed out that, as a result of the design of atomizing element 114" described above, when the atomizing element is running empty, that is, when no mold wall treatment agent is being supplied to distribution chamber 114*f*', a blower effect is created by the centrifugal forces and the entrainment effect which the various surfaces and the adjoining air layers exert. The blower effect allows air to flow out of distribution chamber 114*f*' through distribution channels 114*h*" and along atomizing surface 114*i*1". In a design of atomizing element 114" according to FIG. 8, this blower effect is reinforced by the fact that outer boundary surfaces 114*b*2" of disk element 114*b*" and of ring-shaped shoulder 114*e*" are essentially parallel to, and a short distance away from, atomizing surface 114*i*1", so that a narrow, ring-shaped gap, expanding conically in spray direction H, is formed between these two surfaces. The entrainment effect of this ring-shaped gap on the air pre sent in it reinforces the blower effect, so that, when no more mold wall treatment agent is being introduced into distribution chamber 114*f*', whatever mold wall treatment agent still present in this distribution chamber is expelled completely from distribution chamber 114*f*' by the centrifugal forces and the blower effect. Atomizing element 114" is thus completely self-cleaning in operation.

It should also be added that, in the embodiment of spray element 26" according to FIG. 7, base part 116" and a gap-forming ring 172" cooperate to form an nonadjustable outlet gap 130*b*"; the ring forms the boundary of a distribution chamber 130" connected to control air feed lines 128". In correspondence with the embodiment according to FIG. 3, however, outlet gap 130*b*" of the embodiment according to FIG. 7 can also be designed to be adjustable. In FIG. 7, a feed line for mold wall treatment agent is designated 126.

It should also be mentioned that the spray element according to the invention and thus the entire mold spray system is also suitable for the spraying of conventional, water-diluted mold wall treatment agents. The system can be adapted to the lower viscosity of the treatment agent-water mixture by, for example, choosing the appropriate rotational speed of the drive unit and by adjusting the air throughput correspondingly.

The present description is for illustrative purposes only, and should not be construed to limit the scope of the present invention in any way. Thus, those skilled in the art will appreciate that various modifications, alterations and departures may be made from and to the disclosed embodiments, without departing from the intended spirit and scope of the claims. Other aspects, features and advantages will be apparent upon an examination of the attached drawing Figures and appended claims.

What is claimed is:

1. A sprayer for spraying mold wall treatment agent on the walls of a mold comprising:

a spray element body;

a rotor mounted with freedom to rotate around an axis of rotation in said spray element body;

an atomizing element attached to one end of said rotor;

a head portion movable relative to said atomizing element and positioned about said rotor;

a first feed line for mold wall treatment agent;

a second feed line for control air which directs mold wall treatment agent atomized by the atomizing element toward mold walls to be sprayed;

an outlet of the control air feed line is located proximate an outside circumference of the atomizing element;

wherein an adjustment of a position of said head portion adjusts a discharge amount of said control air.

2. A spray element according to claim 1 wherein the outlet of the control air feed line comprises a plurality of openings arranged in a circle around the atomizing element.

3. A spray element according to claim 1 wherein the outlet of the control air feed line comprises a slot forming a circle around the atomizing element.

4. A spray element according to claim 3 wherein the control air feed line comprises a ring-shaped channel upstream of the outlet slot.

5. A spray element according to claim 4 wherein the control air feed line is formed at least partially by a head part of the spray element body movable relative to a base part of the spray element body.

6. A spray element according to claim 5 wherein adjustment of the head part adjusts an area of the outlet slot.

7. A spray element according to claim 5 wherein the ring shaped channel is bounded on the radially outward side by the head part and on the radially inward side by the base part, or an element connected to it.

8. A spray element according to claim 5 wherein in the area of its outlet, the control air feed line is designed to taper in the outlet direction of the control air.

9. A spray element according to claim 1 further comprising a third feed line for delivery of deflecting air positioned proximate the control air outlet.

10. A spray element according to claim 1 and further comprising a diaphragm mounted to said spray element and adjustable to adjust an area of the outlet.

11. A spray element according to claim 10 wherein said diaphragm is a diaphragm ring attached at an end of said spray element body, said ring having a varying width about its circumference, and rotatable to adjust an orientation of the spray cone of the spray element.

12. A spraying element for preparing the walls of a mold for the molding or shaping of a molded part comprising:

a sprayer body;

a rotor rotatably mounted in the sprayer body;

an atomizer integrally connected to said rotor;

a mold wall treatment agent feed line positioned to supply mold wall treatment agent to said atomizer;

a control air feed line in said sprayer body and having an outlet proximate said atomizer;

wherein said control air feed line supplies air for urging atomized mold wall treatment agent in the direction of a mold wall to be treated.

13. The spraying element of claim 12 further comprising a plurality of control air feed lines radially positioned about the axis of rotation of said rotor, said feed lines having air throughputs independently controllable to adjust an orientation of the spray cone of said spraying element.

14. The spraying element of claim 12 wherein said sprayer body comprises a main part and a head part, said head part being movable to adjust discharge of control air.

15. The spraying element of claim 12 wherein axial movement of the head part adjusts the discharge rate of control air.

16. The spraying element of claim 12 wherein axial movement of the head part adjusts the discharge direction of the control air.

17. The spraying element of claim 12 further comprising a rotatable diaphragm disk attached externally of the sprayer body, said disk having a rounded opening for discharge of mold wall treatment agent and control air, and arranged eccentrically with respect to an axis of rotation of the rotor.

18. The spraying element of claim 12 further comprising:

a disk element connected with said rotor; and a funnel member attached to said disk, said funnel having a conical atomizing surface opening in a spray direction;

wherein at least one of said disk element and said funnel member includes a plurality of radial distribution passages oriented substantially transverse to an axis of rotation of said rotor for delivery of mold wall treatment agent from said opening to said atomizing surface.

19. The spraying element of claim 18 wherein an outlet of said mold wall treatment agent feed line extends into a distribution chamber defined at least partially by said disk.

* * * * *

UNITED STATES PATENT AND TRADEMARK OFFICE

CERTIFICATE OF CORRECTION

PATENT NO. : 6,802,459 B2
DATED : October 12, 2004
INVENTOR(S) : Renkl et al.

It is certified that error appears in the above-identified patent and that said Letters Patent is hereby corrected as shown below:

Column 1,
Line 43, delete “how ever” and insert -- however -- after “castings”.

Column 2,
Line 35, delete “pre vents” and insert -- prevents -- after “barrier”.

Column 3,
Line 27, delete “pre pare” and insert -- prepare -- after “the mold to”.
Line 58, delete “con trolling” and insert -- controlling -- after “unit for”.

Column 4,
Line 28, delete “prefer ably” and insert -- preferably -- after “coolant”.

Column 5,
Line 46, delete “how ever” and insert -- however -- after “with water”.

Column 6,
Line 59, delete “corn position” and insert -- composition -- after “view of its”.

Column 7,
Line 18, delete “con junction” and insert -- conjunction -- after “finely in”.

Column 9,
Line 38, delete “sup plied” and insert -- supplied -- after “of fluid”.
Line 10, delete “con tours” and insert -- contours -- after “with complicated”.

Column 10,
Line 65, delete “corn pressed” and insert -- compressed -- after “The use of”.

Column 11,
Line 42, delete “corn pressed” and insert -- compressed -- after “operated with”.

Column 14,
Line 52, delete “them selves” and insert -- themselves -- after “in and of”.

Column 15,
Line 38, delete “corn pressed” and insert -- compressed -- after “through a”.
Line 49, delete “con tact” and insert -- contact -- after “in good thermal”.

UNITED STATES PATENT AND TRADEMARK OFFICE

CERTIFICATE OF CORRECTION

PATENT NO. : 6,802,459 B2
DATED : October 12, 2004
INVENTOR(S) : Renkl et al.

It is certified that error appears in the above-identified patent and that said Letters Patent is hereby corrected as shown below:

Column 16,
Line 8, delete “con tact” and insert -- contact -- after “duration of the”.
Line 38, delete “con trolling” and insert -- controlling -- after “for the sake of”.

Column 19,
Line 32, delete “corn pressed” and insert -- compressed -- after “effect which this”.

Column 21,
Line 38, delete “pre sent” and insert -- present -- after “gap on the air”.

Signed and Sealed this

Twenty-seventh Day of December, 2005

JON W. DUDAS
*Director of the United States Patent and Trademark Office*